US005732630A

United States Patent [19]

Puschnerat et al.

[11] Patent Number: 5,732,630

[45] Date of Patent: Mar. 31, 1998

[54] RUBBER BLANKET FOR A RUBBER BLANKET CYLINDER

[75] Inventors: Helmut Puschnerat, Wachenheim; Wolfgang Günter Ruckmann, Würzburg; Peter Schröder, Hessheim, all of Germany

[73] Assignee: Koenig & Bauer-Albert Aktiengesellschaft, Wurzburg, Germany

[21] Appl. No.: 772,134

[22] Filed: Dec. 20, 1996

[30] Foreign Application Priority Data

Dec. 21, 1995 [DE] Germany ..... 195 47 917.3

[51] Int. Cl.[6] ..... B41F 1/22

[52] U.S. Cl. ..... 101/415.1

[58] Field of Search ..... 101/415.1; 428/909

[56] References Cited

U.S. PATENT DOCUMENTS

| | | | |
|---|---|---|---|
| 2,547,220 | 4/1951 | Merrill | 428/78 |
| 3,765,329 | 10/1973 | Kirkpatrick et al. | 101/415.1 |
| 4,635,550 | 1/1987 | Brands et al. | 101/415.1 |
| 4,848,204 | 7/1989 | O'Connor et al. | 83/659 |

FOREIGN PATENT DOCUMENTS

| | | |
|---|---|---|
| 29 37 793 | 4/1981 | Germany . |
| 43 20 464 | 12/1994 | Germany . |
| 2114935 | 9/1983 | United Kingdom . |

*Primary Examiner*—Edgar S. Burr
*Assistant Examiner*—Leslie Grohusky
*Attorney, Agent, or Firm*—Jones, Tullar & Cooper, P.C.

[57] ABSTRACT

A rubber blanket unit is structured having an underlying support plate with angled end legs, and an overlying rubber blanket with leading and trailing ends. The rubber blanket unit is secured to a blanket cylinder by insertion of the end legs into a thin cylinder slit. The rubber blanket ends are formed each having a reduced thickness and each further having a closure element. The leading and trailing blanket end closures cooperate to form an essentially seamless rubber blanket when the blanket unit is in place. The blanket ends are not dislodged by mechanical or chemical cleaning.

19 Claims, 3 Drawing Sheets

RUBBER BLANKET FOR A RUBBER BLANKET CYLINDER

FIELD OF THE INVENTION

The present invention is directed generally to a rubber blanket unit for a rubber blanket cylinder. More particularly, the present invention is directed to a rubber blanket unit for a rubber blanket cylinder of a rotary printing press. Most specifically, the present invention is directed to a rubber blanket unit having a rubber blanket, with blanket end closure elements, secured to a blanket support plate with angled ends extending past the rubber blanket ends. The rubber blanket ends are each of reduced thickness and the blanket end closure elements cooperate with each other to join the rubber blanket ends together. The end closure elements generally overlie the beveled or angled end legs of the support plate, with these end legs being inserted into an axially extending thin cylinder slit in the rubber blanket cylinder, when the rubber blanket unit has been placed on the rubber blanket cylinder.

DESCRIPTION OF THE PRIOR ART

In the field of rotary printing, there is frequently required the use of a blanket cylinder which carries a rubber blanket. In some instances, the rubber blanket is permanently attached to the cylinder or may be in the form of a sleeve or tube which is slid over the cylinder. More typically, a rubber blanket unit, which includes an outer resilient rubber blanket and an underlying support plate to which the rubber blanket is bonded, is removably attached to the blanket cylinder. While a variety of arrangements can be used to secure the support plate of the rubber blanket unit to the blanket cylinder, in one such arrangement, the support plate is provided with beveled or angled ends. These ends provide end legs that are inserted into an axially extending, relatively thin slit in the blanket cylinder. The width of the slit should be kept as narrow as possible to maximize the useable surface area of the rubber blanket. In the prior art, there has typically existed an axially extending gap or opening between the two ends of the rubber blanket when the support plate end legs have been inserted into the blanket cylinder slit. This gap has acted as a collection point for dust and ink and has been apt to cause print quality problems.

An associated problem with the prior art rubber blanket units has been one of separation of the rubber blanket from the underlying support plate at the rubber blanket ends. The gap between the rubber blanket ends may allow either mechanical or chemical blanket cleaning arrangements to cause the separation of the blanket ends or edges from the support plate. Such a separation will again result in print quality problems and in possible damage to the rubber blanket unit.

It will be apparent that a need exists for a rubber blanket unit which overcomes the limitations of the prior art. The rubber blanket for a rubber blanket cylinder in accordance with the present invention provides such a device and is a significant improvement over the prior art.

SUMMARY OF THE INVENTION

It is an object of the present invention to provide a rubber blanket unit for a rubber blanket cylinder.

Another object of the present invention is to provide a rubber blanket unit for a rubber blanket cylinder of a rotary printing press.

A further object of the present invention is to provide a rubber blanket unit having a rubber blanket with blanket ends and a support plate with beveled end legs.

Yet another object of the present invention is to provide a rubber blanket unit having rubber blanket end closure elements.

Still a further object of the present invention is to provide a rubber blanket unit having overlapping rubber blanket ends of reduced thickness.

Even yet another object of the present invention is to provide a rubber blanket unit having a rubber blanket with end closures that resist separation from the support plate.

As will be discussed in detail in the description of the preferred embodiments, which is presented subsequently, the rubber blanket unit for a rubber blanket cylinder of a rotary printing press in accordance with the subject invention includes a rubber blanket that is attached to an underlying support plate. The support plate and the rubber blanket constitute a rubber blanket unit which is securable to a blanket cylinder of a rotary printing press by insertion of end legs of the beveled or angled support plate ends into a thin, axially extending slit on the periphery of the blanket cylinder. The rubber blanket has leading and trailing blanket ends. These blanket ends are each of reduced thickness and overlap each other when the rubber blanket unit is placed on the blanket cylinder. The overlapping rubber blanket ends are engageable with each other so that they will be fastened together. This engagement can be by the use of adhesives, interlocking elements, hook and loop fasteners or other cooperating engagement means. The result is an essentially endless rubber blanket.

The engaging ends of the rubber blanket of the present invention provide a rubber blanket unit whose blanket ends will not separate from each other, or from the underlying support plate even during very intensive mechanical or chemical cleaning. This insures that the rubber blanket will stay attached to the support plate and will not delaminate or be pulled apart from the support plate. The life of the rubber blanket unit is thereby increased and there is much less likelihood of print quality deteriorization.

The overlapping arrangement of the rubber blanket ends in the rubber blanket unit of the present invention effectively eliminates the gap which has existed in prior art devices. Since this gap is eliminated, there is no place for paper dust and ink to collect, as has been the case with prior art devices. The elimination of this gap also has a beneficial effect on the quality of the printed products produced by the rotary printing press which utilizes the rubber blanket unit in accordance with the present invention.

The rubber blanket unit for a rubber blanket cylinder in accordance with the present invention overcomes the limitations of the prior art. It is a substantial advance in the art.

BRIEF DESCRIPTION OF THE DRAWINGS

While the novel features of the rubber blanket for a rubber blanket cylinder in accordance with the present invention are set forth with particularity in the appended claims, a full and complete understanding of the invention may be had by referring to the detailed description of the preferred embodiments which is presented subsequently, and as illustrated in the accompanying drawings, in which:

DETAILED DESCRIPTION OF THE PREFERRED EMBODIMENTS

Figure 1:
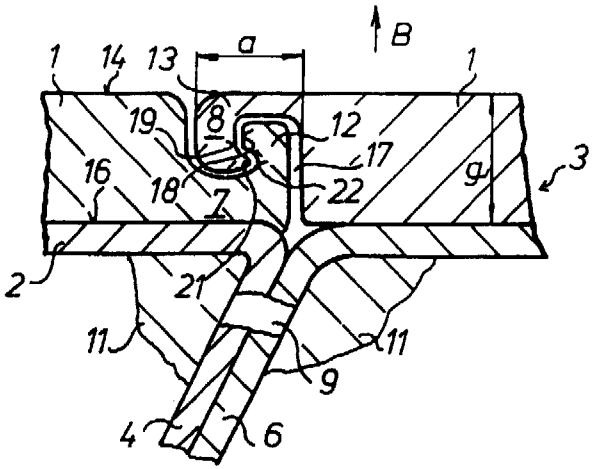
FIG. 1 is a schematic side elevation view of the ends of a rubber blanket unit in accordance with the present invention positioned on a blanket cylinder and showing a first preferred embodiment of end closure elements.

Referring initially to FIG. 1, there may be seen a first preferred embodiment of a rubber blanket unit for a rubber blanket cylinder in a rotary printing press in accordance with the present invention. A rubber blanket 1 is secured, by suitable material contact such as by gluing, vulcanizing, or the like, to a dimensionally stable support plate 2 to form a rubber blanket unit 3. As the lowest or bottom layer of the rubber blanket unit 3, the support plate 2 can also be made of, for example, plastic or fiberglass-reinforced plastic or another compound material. It can also be made of one of a number of suitable metals. End legs 4 and 6 of the support plate 2, which may be, for example made of metal, and of a thickness of 0.3 mm, for example, project past ends 7 and 8 of the rubber blanket 1. The end legs 4 and 6 of the support plate 2 are beveled or angled and are held frictionally or by means of a suitable holding device, not shown, in an axially extending slit 9 located on the periphery of a rubber blanket cylinder 11. The first and second support plate end legs 4 and 6 and their associated first and second rubber blanket ends 7 and 8 may be either the leading and trailing ends of the rubber blanket unit 3, or the trailing and leading ends, depending on the direction of rotation of the rubber blanket cylinder 11. In the following discussion the end 7 will be designated as the leading end.

Again referring to FIG. 1, the thickness of each of the leading and trailing ends 7 and 8 of the rubber blanket 1 is less than the thickness "g" of the body of the rubber blanket 1. In a first preferred embodiment, as seen in FIG. 1, leading and trailing ends 7 and 8 of the rubber blanket 1 have a lower closure element 12, and an upper closure element 13, respectively. The lower closure element 12 consists of a lower lip 12, which is hook-shaped in cross section and which extends in a direction axially parallel with the rubber blanket cylinder 11. The lower hook lip 12 of the leading end 7 of the rubber blanket 1 in this case points or faces in the direction of the outer surface 14 of the rubber blanket 1. The second, upper closure element 13 consists of an upper counter hook lip 13, which is arranged at the trailing end 8 of the rubber blanket 1 and which points in the direction of the inner surface 16 of the rubber blanket 1. Both hook lips 12 and 13 overlap by an amount "a", which consists of the width of the hook lip 12 or counter hook lip 13 plus a gap 17. This gap 17 is formed by a distance between a front face of the lower closure element 12 of the blanket leading end 7 and a front face, located opposite it, of the blanket trailing end 8 of the rubber blanket 1. The gap 17 is required for making the yielding of the elastic hook-shaped closure element possible, so that a hook edge 18 of the lower hook lip 12 of the rubber blanket 1 can interlockingly engage a hook channel 19 of the upper counter hook lip 13. On the other side, a hook edge 21 of the upper counter hook lip 13 of the rubber blanket 1 comes into interlocking engagement with a hook channel 22 of the lower hook lip 12. The closure elements 12 and 13 are releasably connected with each other, i.e. hooked, in the radial direction of the rubber blanket cylinder 11 and are opened in the opposite direction, indicated by arrow B in FIG. 1. The thickness "g" of the rubber blanket 1 is no greater than a thickness of the two overlapping closure elements 12 and 13 in their operating position.

Figure 2:
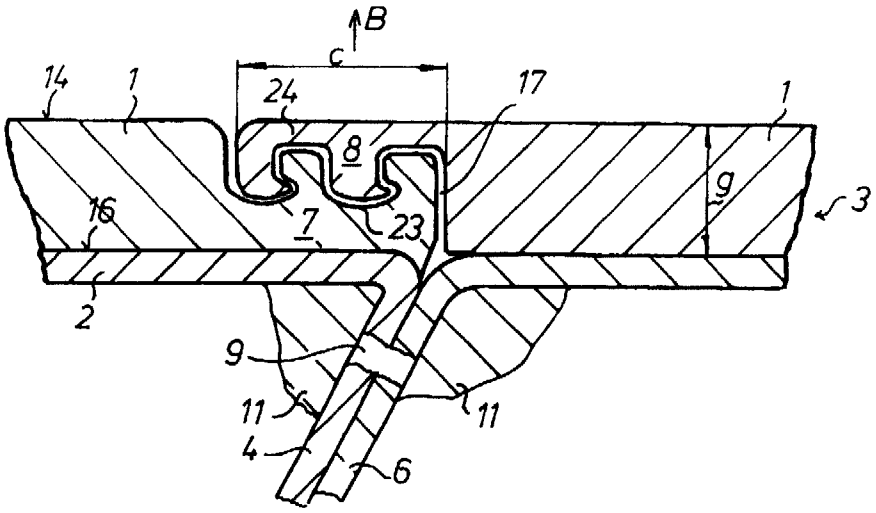
FIG. 2 is a view similar to FIG. 1 and showing a second preferred embodiment of end closure elements.

Turning now to FIG. 2, there may be seen a second preferred embodiment of a rubber blanket unit for a blanket cylinder in accordance with the present invention. In this second preferred embodiment, as seen in FIG. 2, each of the first and the second closure elements located at the blanket ends 7 and 8 is embodied as a lower multiple hook lip 23 at the blanket leading end 7, and as an upper multiple counter hook lip 24 on the blanket trailing end 8. This means that, in comparison to the first preferred embodiment, shown in FIG. 1, that a second hook lip is attached by material contact to a first hook lip, and extending parallel with it in the circumferential direction of the rubber blanket 1. An inner surface of the lower multiple counter hook lip 23 is identical with the inside 16 of the rubber blanket 1. The multiple hook lip 23 of the leading end 7 faces in the direction of the outer surface 14 of the rubber blanket 1. The upper multiple counter hook lip 24 at the trailing end 8 of the rubber blanket 1 points in the direction of the inner surface 16 of the rubber blanket 1. An outer surface of the upper multiple counter hook lip 23 is the same as the outer surface 14 of the rubber blanket 1. Both closure elements overlap by an amount "c", which consists of the width of a multiple hook lip 23 or a multiple counter hook lip 24 plus a gap 17. The hook edges and hook channels of the blanket end closure parts 23 and 24 are structured the same as has been previously described in connection with the first preferred embodiment which is shown in FIG. 1.

The hook lip 12 and counter hook lip 13 as well as the multiple hook lip 23 and the multiple counter hook lip 24 of the leading and trailing ends 7 and 8 of the rubber blanket 1 can be made of the same material as the rubber blanket 1. It is also possible to make this hook lip 12 and counter hook lip 13 as well as the multiple hook lip 23 and the multiple counter hook lip 24 of plastic and to connect these lips by material contact, or other suitable means, with the rubber blanket ends. In this case, the outer surface 14 of the counter hook lip 13 or of the multiple counter hook lip 23 in particular, which is fastened on the trailing end 8 of the rubber blanket 1, can be provided with a rubber coating.

The joining of the hook lip 12 with the counter hook lip 13 or of the multiple hook lip 23 with the multiple counter hook lip 24 to form an interlocking connection of both ends 7 and 8 of the rubber blanket is performed by placing both elements 12 and 13 or 23 and 24 on top of each other and pressing them together. A separation of both elements 12 and 13 or 23 and 24 can be performed in that at least a portion of the upper counter hook lip 13 or multiple counter hook lip 24 which is disposed on the trailing end 8 of the rubber blanket 1 extends laterally, in the form of a strap, past the surface of the rubber blanket cylinder 11. Thus, this strap can be pulled open in the axis-parallel direction of the rubber blanket cylinder 11. It is also possible to perform the separation of the two elements 12 and 13 or 23 and 24 by insertion of a slide between the elements 12 and 13 or 23 and 24. This slide would be moved in an axis parallel direction to separate the rubber blanket ends 7 and 8.

Figure 3:
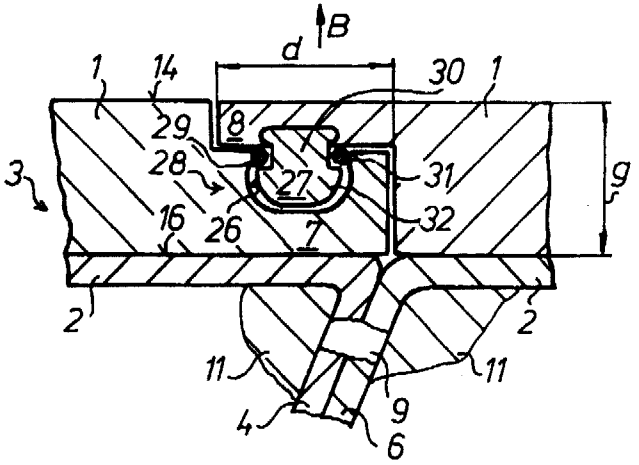
FIG. 3 is a view similar to FIGS. 1 and 2 and showing a third preferred embodiment of end closure elements.

A third preferred embodiment of a rubber blanket unit for a rubber blanket cylinder in accordance with the present invention is shown in its assembled configuration in FIG. 3. As may be seen in FIG. 3, the leading and trailing ends 7 and 8 of the rubber blanket 1 have lower and upper closure elements 26 and 27, respectively that form cooperating parts of snap fasteners 28 which are arranged in a row. In this embodiment, the ends 7 and 8 of the rubber blanket 1 overlap by an amount "d". The lower and upper closure elements 26 and 27 are oriented toward each other in the manner previously mentioned and, when interlockingly engaged, can be releasably connected. The thickness "g" of the rubber blanket 1 is not greater than the thickness of the two overlapping closure elements 26 and 27 in their operational position.

The lower closure elements 26 are disposed at the leading end 7 of the rubber blanket and extend, spaced apart from each other, axis-parallel with the rubber blanket cylinder 11. In this case the lower closure elements 26 can be circular blind holes, which open in the direction of the outer surface 14 of the rubber blanket 1. Two rod-shaped spring elements 29 and 31 each extend across the width of the leading end 7 of the rubber blanket in the vicinity of an upper rim of the lower closure elements 26, all as may be seen most clearly in FIG. 3.

The upper closure elements 27, which are shown in FIG. 3, are fastened by material contact at the trailing end 8 of the rubber blanket 1 and extend axis-parallel with the rubber blanket cylinder 11 and at the same spacing distances as the lower closure elements 26. The upper closure elements 27 are each generally mushroom-shaped and point in the direction of the inner surface 16 of the rubber blanket 1. These upper closure elements 27 each consist essentially of a shaft 30 which is provided with an annular bulge or mushroom shaped button 32 on its free, lower end. In the operating position, the spring elements 29 and 31 of the lower closure element 26 extend behind the annular bulge 32, so that both closure elements 26 and 27 will be interlockingly connected with each other. The closure elements 26 and 27 can be separated from each other by movement of the upper closure elements 27 in the opening direction B and are closed by movement of elements 27 in the opposite direction. Opening of the row of snap fasteners 28 can be performed, for example, in that the trailing end 8 of the rubber blanket 1 has a strap which laterally projects past the surface of the rubber blanket 1. This strap, which is not depicted in the drawings, can be grasped and can be pulled upwardly, or in the opening direction B to pull the upper closure element heads 32 out of the lower closure element blind holes 26.

Figure 4:
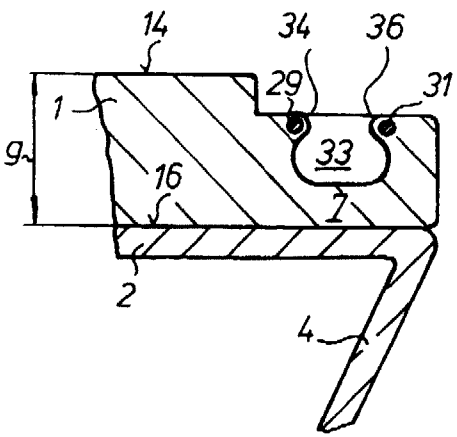
FIG. 4 is a schematic side elevation view of a leading end of a rubber blanket unit in accordance with a fourth preferred embodiment.
Figure 8:
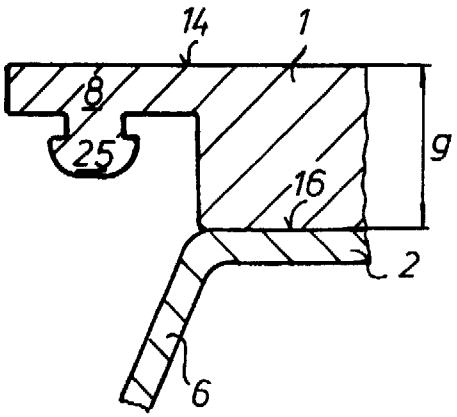
FIG. 8 is a schematic representation of the trailing end of a rubber blanket and showing a closure element adapted to engage the leading end closure element shown in FIG. 4.

In place of a plurality of holes placed in the lower closure element 26 at a distance from each other, it is also possible for the lower closure element to be provided as a groove 33 extending axially instead of the line of the holes, as seen in a fourth preferred embodiment depicted in FIG. 4 and also in FIG. 8. This axially extending groove 33 has a cross section which, as seen in FIG. 4, corresponds to the longitudinal section through a blind hole, as shown in FIG. 3, inclusive of the spring elements 29 and 31. In this configuration, the rod-shaped spring elements 29 and 31 are situated at upper lateral edges 34 and 36 of the groove 33, whose cross section widens toward the interior of the lower closure element and extend through the leading end 7 of the rubber blanket 1 over a total width in the axis-parallel direction with the rubber blanket cylinder 11. Thus, in the operational state, upper closure element 27, which can be made of several individual mushroom-shaped buttons 32, or which alternatively can be made of one or several bars of mushroom-shaped cross section, cooperates interlockingly with the groove 33. It is also possible to bring a bar-shaped counter hook lip 25, fastened on the trailing end 8 of the blanket 1 into interlockingly releasable contact with the groove 33 of the leading end 7 of the rubber blanket 1.

Figure 5:
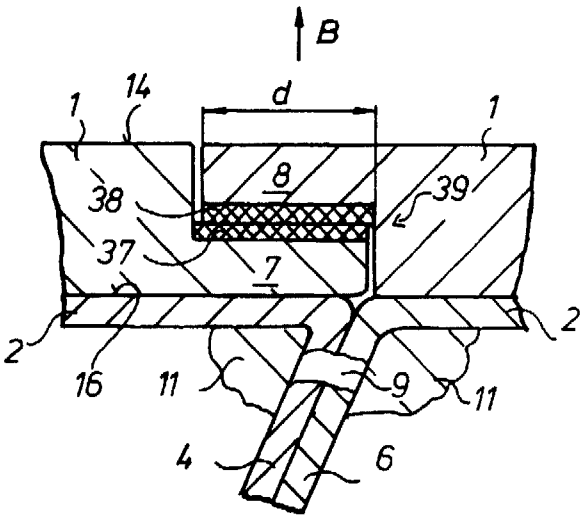
FIG. 5 is a schematic side elevation view of the ends of a rubber blanket unit in accordance with the present invention and showing a fifth preferred embodiment of the end closure elements.

A fifth preferred embodiment of a rubber blanket unit for a rubber blanket cylinder in a rotary printing press is depicted in FIG. 5. In this fifth preferred embodiment, each of the leading and trailing ends 7 and 8, respectively of the rubber blanket 1 are slightly less than half the thickness, in an overlapping length "d", of the blanket 1 and each has a thickness of, for example, 5 mm. The faces of the overlapping blanket ends 7 and 8, which are facing each other, are each provided with a closure element consisting of a hook layer 37 and a loop layer 38 of a VELCRO® or other similar hook and loop closure 39. The hook layer 37 and the loop layer 38 can be reversed with respect to the blanket leading and trailing ends 7 and 8. In a useful manner, the trailing end 8 of the rubber blanket 1 has the end of the rubber blanket 1 which is longer by an amount "d" in respect to the location of the beveled or angled ends 4 and 6 of the support plate 2.

Figure 6:
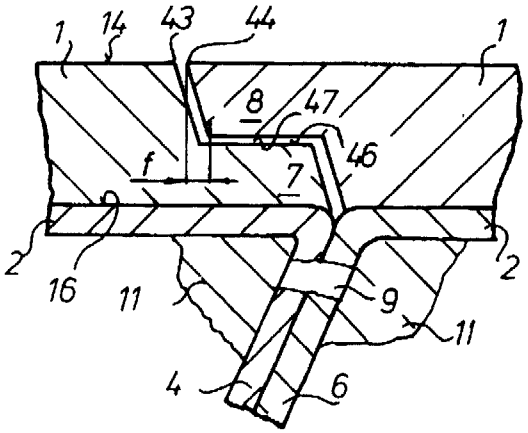
FIG. 6 is a view similar to FIG. 5 and showing a sectional view of a sixth preferred embodiment of the end closure elements and taken along line VI—VI of FIG. 7.
Figure 7:
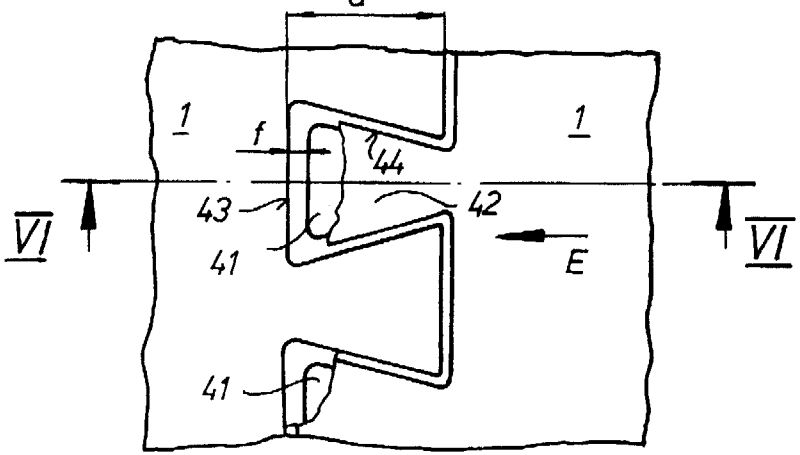
FIG. 7 is a top plan view of the rubber blanket unit depicted in FIG. 6.

In accordance with a sixth preferred embodiment, as shown in FIGS. 6 and 7, the leading and trailing ends 7 and 8 of the rubber blanket 1 each have a series of interdigitating recesses 41 and tongues 42, which are arranged spaced apart next to each other, and which serve as the closure elements. The tongues 42 of the end trailing 8 hookingly engage the recesses 41 of the leading end 7, so that an interconnected, but again releasable connection of both ends 7 and 8 with each other is created.

It is particularly advantageous if the basic shapes of both the recesses 41 and the tongues 42 are generally trapezoidal. This means that each tongue 42 is trapezoidally widened in the direction of rotation E of the rubber blanket cylinder 11. The recesses 41 are also generally trapezoidally shaped, as depicted in FIG. 7. It is furthermore of advantage for the edges 43 of the recesses 41 to taper from the outer surface 14 of the blanket 1 in the direction toward the inner surface 16 of the rubber blanket 1, for example by an amount "f" of 0.1 mm. The edges 44 of the tongues 42 are also tapered in the same way from the outer surface 14 in the direction toward the inner surface 16 of the rubber blanket 1. It is also possible to keep the amount "f" for the taper of the edges 44 of the tongues 42 less, in order to reduce a gap formation between the two edges 43 and 44 of the recesses and tongues, as seen in FIG. 7. It is also advantageous for the bottom surfaces 46 of the recesses 41 and the undersides 47 of the tongues 42 to each be provided with a layer, such as a hook layer 37 or a loop layer 38 of a VELCRO® or similar hook and loop closure 39. Opening of the two closure elements 41 and 42 can again be accomplished by means of a tear strap which is laterally attached to the trailing end 8 of the rubber blanket 1 and which is located outside the surface of the blanket cylinder 11. An upward movement of the tear strap will separate the rubber blanket trailing end 8 from the rubber blanket leading end 7.

Figure 9:
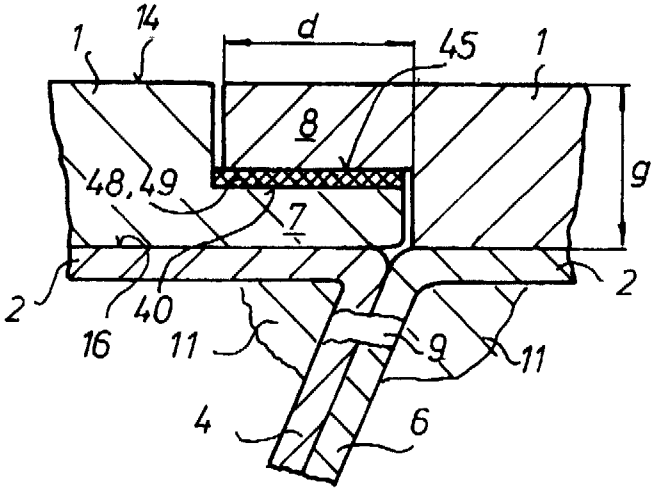
FIG. 9 is a view similar to FIG. 1 and showing a seventh preferred embodiment of the present invention.

There is shown a seventh preferred embodiment of a rubber blanket unit for a rubber blanket cylinder of a rotary printing press in accordance with the present invention in FIG. 9. In this seventh preferred embodiment, the cooperating surfaces 40 and 45, which are facing each other, of the leading and trailing ends 7 and 8 of the rubber blanket 1 can each be provided with an adhesive 48 in place of the VELCRO® or similar hook and loop type closure 39, which was depicted in FIG. 5. This adhesive 48 facing on each surface 40 and 45, can be releasably or non-releasably connected with each other in this way, as shown in FIG. 9. An adhesive 49 is provided for a releasable connection, which first fixedly connects the tongue-shaped leading and trailing ends 7 and 8, which are reduced in their thickness "g" and which overlap at least on one surface 40 or on both surfaces 40 and 45, with each other. With the application of heat, for example by means of radiated heat at >60° C., the heat-sensitive adhesive connection can be released, so that the leading and trailing ends 7 and 8 of the rubber blanket 1 can be separated again by lifting them.

Figure 10:
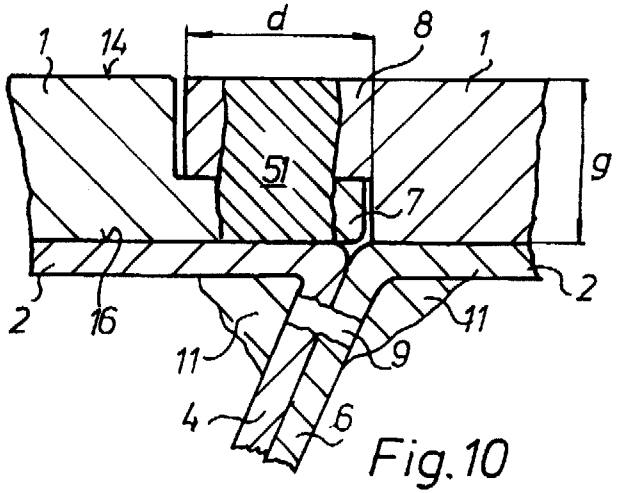
FIG. 10 is a view similar to FIG. 1 and showing an eighth preferred embodiment of the present invention.

In accordance with an eighth preferred embodiment, each of the leading and trailing ends 7 and 8 of the rubber blanket 1 can be prepared in the same way as in the previously mentioned seventh preferred embodiment. However, the ends 7 and 8 or the blanket tongues, which can be overlapped and which are reduced in thickness, are placed on top of each other without the application of an adhesive 48 or 49 and are subsequently welded together by, for example, spot-welding at a connection point 51, as seen in FIG. 10. Such a connection point 51 between the two ends 7 and 8, created by material contact by means of spot-welding, can be generated by means of a known neodymium-YAG laser. A series of spaced-apart connection points 51 are created, and will extend in an axis-parallel direction with the rubber blanket cylinder 11.

A separation of the spot-welded connection points 51, or of the leading and trailing ends 7 and 8 of the blanket, which are connected with each other by means of the adhesive 48, can take place by tearing apart the adhesion or spot-welds 51 in the vicinity of the slit 9 of the rubber blanket cylinder 11. To do this, a loosening wedge will be pushed between the two tongues 7 and 8, which have previously been connected with each other. Depending on the selection of the adhesive 49, the connection between the two tongue-shaped ends can be so solid, that a non-releasable connection between them can be created. The ends 7 and 8 can also be connected with each other by fusion welding in the area of the overlap of the two ends 7 and 8 of reduced thickness of the rubber blanket 1.

In all of the several preferred embodiments of the present invention, which have been discussed above, the principle of the invention is the provision of leading and trailing ends 7 and 8 of the rubber blanket 1 each having a reduced thickness and being capable of being secured together in an overlapping manner to form an essentially continuous rubber blanket 1 of the rubber blanket unit 3. The two overlappable blanket ends can be releasably or non-releasably connected with each other. In addition, the rubber blanket 1 can be embodied as a single layer or alternatively as multiple layers.

While preferred embodiments of a rubber blanket for a rubber blanket cylinder in accordance with the present invention have been set forth fully and completely hereinabove, it will be apparent to one of skill in the art that a number of changes in, for example, the overall size of the blanket unit and blanket cylinder, the attachment mechanism used to attach the blanket to the blanket cylinder, the drive arrangement for the blanket and the like could be made without departing from the true spirit and scope of the present invention which is accordingly to be limited only by the following claims.

What is claimed is:

1. A rubber blanket unit for a rubber blanket cylinder of a rotary printing press comprising:

a dimensionally-stable support plate having first and second beveled ends with end legs, said end legs being fastenable in a slit of a rubber blanket cylinder;

a rubber blanket secured on an inner surface thereof to an outer surface of said support plate and having leading and trailing ends, said end legs of said support plate being free of said rubber blanket; and means for interlockingly and releasably connecting said leading and trailing rubber blanket ends.

2. The rubber blanket unit of claim 1 wherein each of said leading and trailing rubber blanket ends is reduced in thickness and has a closure element, said closure elements on said leading and trailing rubber blanket ends being interlockingly engageable when said rubber blanket leading and trailing ends overlap each other.

3. The rubber blanket unit of claim 2 wherein said closure elements include a first closure element having at least a lower hook lip and a second closure element having at least an upper counter hook lip, said hook lip and said counter hook lip facing each other when said rubber blanket ends overlap each other, said hook lip and said counter hook lip being releasably hooked together.

4. The rubber blanket unit of claim 3 wherein said first closure element includes a plurality of said lower hook lips and further wherein said second closure element includes a plurality of said upper counter hook lips.

5. The rubber blanket unit of claim 2 wherein said closure elements on said leading and trailing rubber blanket ends are a plurality of snap fasteners.

6. The rubber blanket unit of claim 5 wherein each said snap fastener includes a groove which is trapezoidal in cross-section on one of said rubber blanket ends, said groove being defined by groove edges, and further including rod-shaped springs in said groove edges.

7. The rubber blanket unit of claim 6 further including a counter hook lip receivable in said groove on the other of said rubber blanket ends.

8. The rubber blanket unit of claim 2 wherein one of said leading and trailing closure elements is a hook layer of a hook and loop fastener and a second of said leading and trailing closure elements is a loop layer of a hook and loop fastener.

9. The rubber blanket unit of claim 1 wherein said leading and trailing blanket ends each have a row of closure elements, said closure elements on a first of said leading and trailing ends consisting of recesses disposed spaced apart from each other, said closure elements on a second of said leading and trailing ends consisting of tongues disposed spaced apart, said tongues being releasably receivable in said recesses.

10. The rubber blanket unit of claim 9 wherein said recesses and said tongues are generally trapezoidal in plan view.

11. The rubber blanket unit of claim 9 wherein said tongues have edges, said edges tapering inwardly in a direction toward said inner surface of said rubber blanket.

12. The rubber blanket unit of claim 9 wherein said recesses have edges, said edges tapering inwardly in a direction toward said inner surface of said rubber blanket.

13. The rubber blanket unit of claim 9 wherein said tongues each have an underside surface and further wherein said recesses each have a bottom surface, said underside surfaces and said bottom surfaces being provided with cooperating components of a hook and loop fastening system.

14. The rubber blanket unit of claim 1 wherein each of said leading and trailing rubber blanket ends is reduced in thickness and wherein both said ends can be overlapped and connected to each other by adhesive.

15. The rubber blanket unit of claim 14 wherein said adhesive forms a releasable connection between said ends.

16. The rubber blanket unit of claim 14 wherein said adhesive forms a non-releasable connection between said ends.

17. The rubber blanket unit of claim 1 wherein each of said leading and trailing rubber blanket ends is reduced in thickness and wherein both said ends can be overlapped and connected to each other by spot welding.

18. The rubber blanket unit of claim 17 wherein a neodymium-YAG-laser is used for said spot welding.

19. The rubber blanket unit of claim 1 wherein each of said leading and trailing rubber blanket ends is reduced in thickness and wherein both said ends can be overlapped.

* * * * *